US011247499B2

(12) United States Patent
Ramirez

(10) Patent No.: US 11,247,499 B2
(45) Date of Patent: Feb. 15, 2022

(54) SYSTEMS AND METHODS FOR CALIBRATING A PRINTER FOR PRINTING LABELS

(71) Applicant: Vincent Ramirez, Montgomery, NY (US)

(72) Inventor: Vincent Ramirez, Montgomery, NY (US)

( * ) Notice: Subject to any disclaimer, the term of this patent is extended or adjusted under 35 U.S.C. 154(b) by 0 days.

(21) Appl. No.: 17/115,912

(22) Filed: Dec. 9, 2020

(65) Prior Publication Data

US 2021/0086536 A1 Mar. 25, 2021

Related U.S. Application Data

(62) Division of application No. 15/084,200, filed on Mar. 29, 2016, now abandoned.

(51) Int. Cl.
*B41J 29/38* (2006.01)
*B41J 3/407* (2006.01)

(52) U.S. Cl.
CPC ..... *B41J 29/38* (2013.01); *B41J 3/4075* (2013.01)

(58) Field of Classification Search
CPC . B41J 29/393; B41J 2029/3935; B41J 3/4075
See application file for complete search history.

(56) References Cited

U.S. PATENT DOCUMENTS

| | | | |
|---|---|---|---|
| 5,823,692 | A | 10/1998 | Tolrud et al. |
| 7,194,957 | B1 | 3/2007 | Leon et al. |
| 2008/0223512 | A1 | 9/2008 | Sievel |

*Primary Examiner* — Julian D Huffman
(74) *Attorney, Agent, or Firm* — Lerner, David, Littenberg, Krumholz & Mentlik, LLP

(57) ABSTRACT

Systems and methods are provided for calibrating a printer for printing labels. According to one aspect, calibration label papers are provided to a printer. Each calibration label paper comprises a horizontal calibration mark and a vertical calibration mark. A test image is printed on a calibration label paper, the test image comprising a horizontal printer mark and a vertical printer mark printed parallel to their respective calibration marks. The calibration marks are compared with their respective printer marks. Using a computing device, coordinates of a virtual label grid representing the calibration label paper are adjusted based on the comparison of the marks. A second test image comprising new printer marks is printed, and the calibration marks are compared with the new printer marks. Upon alignment of the printer marks and the calibration marks, the adjusted coordinates of the virtual label grid are saved as default coordinates for the printer.

1 Claim, 12 Drawing Sheets

500

SYSTEMS AND METHODS FOR CALIBRATING A PRINTER FOR PRINTING LABELS

CROSS-REFERENCE TO RELATED APPLICATIONS

This application is a divisional of U.S. application Ser. No. 15/084,200, filed on Mar. 29, 2016, the disclosure of which is incorporated herein by reference.

TECHNICAL FIELD OF THE INVENTION

This patent application relates generally to the field of computer printing, in particular, to computer-implemented systems and methods for calibrating a printer for the printing of labels.

BACKGROUND OF THE DISCLOSURE

Printers have become increasingly sophisticated regarding their compatibility with various software programs and computing devices. For instance, all inkjet and laser printers, upon purchase, are accompanied by their own print driver software that is installed on a computing device in order for the printer to function properly with that computing device. More specifically, the print driver software, when installed on the computing device, converts the data to be printed into a form specific to the associated print.

However, while virtually all printers have their own print driver software, printers may not always print words or images in the exact same location on the paper as compared with other printers. Most printers come close to aligning the printed words or images with die center spot on the paper, but the accuracy of alignment with the center spot can vary from printer to printer. Although slight misalignments with the center spot may not be noticeable when printing word documents, these slight misalignments can have a detrimental effect during label printing.

For conventional printing of labels, the label paper generally comprises a grid of labels encompassing the printable area of the label printer. As such, using label printing software for example, the printer ideally prints one or more of the same words or images on each label and aligns die words and/or images with the center of each label. It will be appreciated that any number of different label printing software programs from different suppliers can be used. However, if the printer (via the print driver software) slightly misaligns with the center spot on the paper, the text and/or images may not be centered on each label, or worse, may run off of one or more labels such that, upon printing, some labels do not include the entire series of text and/or images.

As such, users are forced to manually move the text and/or images using the label printing software, and print the labels one or more times in the hopes that the text/images are centered on each label, but with no guarantee that the manipulation of the text/images in the label printing software will properly align the text/images with the labels. This repeated manipulation of the text/images and printing is time-consuming and results in the wasting of label paper which can be costly to the user. Further, for each different type of label that a user tries to print (i.e., labels using different text and/or images), the process of a) manipulating the text in the label printing software, b) printing the labels, and c) checking the printed labels to see if the image is aligned must be done again, as there is no way of knowing whether the text/image will properly align with the labels.

Accordingly, what is needed is a system for aligning text and/or images with the label paper that allows for an efficient and cost-effective alignment of the text and/or images within each label upon printing.

SUMMARY OF CERTAIN EMBODIMENTS OF THE DISCLOSURE

Described herein are systems and methods for calibrating a printer for printing labels. According to one aspect, a method for calibrating a printer for printing labels is provided in which a set of calibration label papers is provided to a printer operatively connected to computing device, where each calibration label paper comprises a horizontal calibration mark and a vertical calibration mark located in a margin of the calibration label paper. A first test image is printed on a first calibration label paper using the printer, wherein the test image comprises a first horizontal printer mark parallel to the horizontal calibration mark and a first vertical printer mark parallel to the vertical calibration mark. Using the first test image, the horizontal calibration mark is compared to the first horizontal printer mark and the vertical calibration mark is compared to the first vertical printer mark. Using the computing device, coordinates of a virtual label grid representing the calibration label paper are adjusted based on the comparison of the horizontal calibration mark to the first horizontal printer mark and the vertical calibration mark to the first vertical printer mark. A second test image is then printed on a second calibration label paper using the printer, such that the printer imprints on the second calibration label paper a second horizontal printer mark parallel to the horizontal calibration mark and a second vertical printer mark parallel to the vertical calibration mark. Using the second test image, the horizontal calibration mark is compared to the second horizontal printer mark and the vertical calibration mark is compared to the second vertical printer mark. Upon alignment of the printer marks and the calibration marks, the updated coordinates of the virtual label grid are saved for the printer.

According to another aspect, a calibration label paper configured to assist a user in the calibration of a printer for printing labels is provided. The calibration label paper comprises a printing area having one or more labels, and a label margin having a horizontal calibration mark and a vertical calibration mark. The calibration label paper is configured to be inserted into a standard computer printer and receive a horizontal printer mark and a vertical printer mark from the printer upon test printing. According to a further aspect, the printing area can comprise a grid having a plurality of labels. According to another aspect, the vertical and horizontal calibration marks are shown in a first color and the vertical and horizontal printer marks are printed in a second, different color.

According to another aspect, a system for calibrating a printer for printing labels is provided. The system can include a set of calibration label papers, and a printer configured to print onto the calibration label paper a horizontal printer mark parallel to the horizontal calibration mark, and a vertical printer mark parallel to the vertical calibration mark. The system can further include a computing device operatively connected to the printer and a network. The computing device is configured to adjust coordinates of a virtual label grid corresponding to the horizontal and vertical printer marks, and save the updated coordinates of the virtual label grid for the horizontal and vertical printer marks for the printer.

These and other aspects, features, and advantages can be appreciated from the accompanying description of certain embodiments of the disclosure and the accompanying drawing figures and claims.

DETAILED DESCRIPTION OF CERTAIN EMBODIMENTS OF THE INVENTION

Figure 1:
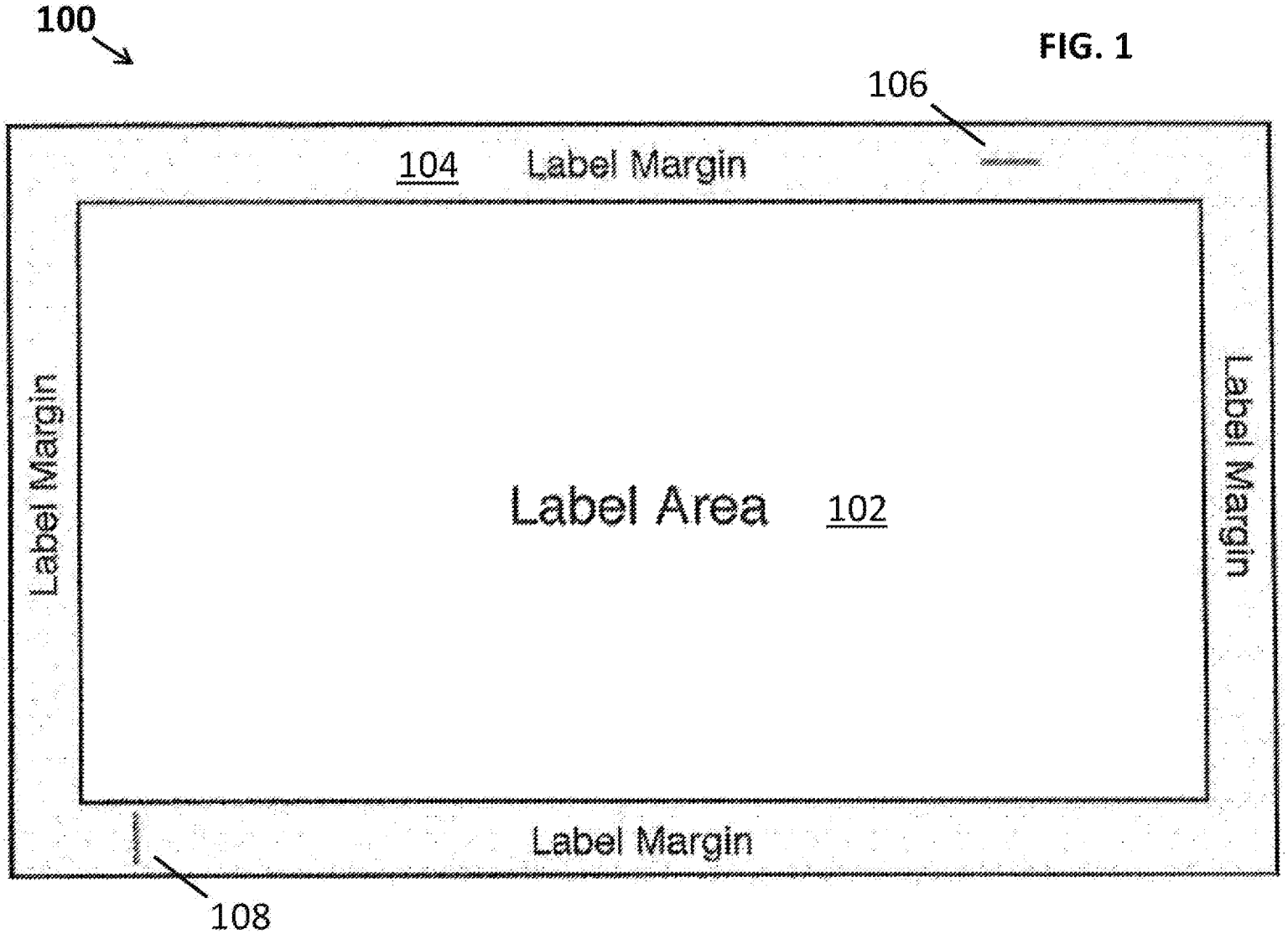
FIG. 1 is a diagram illustrating a calibrating label paper in accordance with at least one embodiment disclosed herein.

By way of overview and introduction, the present disclosure details systems and methods for calibrating a printer for the printing of labels. As present approaches have not been highly effective or efficient in calibrating printers to print labels in which desired text or images are aligned in the center of each label, the present systems and methods utilize various algorithms that execute in a machine to adjust the alignment of the desired text or images based, in part, on user input, thereby calibrating the printer to align the desired text or images in the center of each label, or in other embodiments, any other reference point of the label. The present system and methods further allows the user to save the alignment coordinates specific for each printer, such that when the user desires to print new labels with a particular printer at a later time, no further calibration will be needed.

Specifically, in the system of the present application a printer operatively linked to a computing device is configured to printing a first test image on a first calibration label paper. The calibration label paper includes a label area for the printing of one or more labels, and a label margin having a horizontal calibration mark and a vertical printer mark. In printing the first test image on the calibration label paper, the printer imprints on the calibration label paper a first horizontal printer mark parallel to the horizontal calibration mark and a first vertical printer mark parallel to the vertical calibration mark according to the default settings of the printer driver.

After printing of the first test image, the location of the horizontal printer mark is compared with the location of the horizontal calibration mark and the location of the vertical printer mark is compared with the location of the vertical calibration mark by the user. If the locations of the printer marks exactly match the locations of their respective calibration marks (i.e., completely overlay one another), then the printer is calibrated to print text or images in the center of each label. If the locations of one or both of the printer marks do not match their respective calibration marks, the user, using the computing device, can then be prompted to adjust the coordinates of a virtual label grid (which represents the calibration label paper) on a user interface of a label calibration application based on the comparisons of the printer marks to the calibration marks. The user can adjust the coordinates of the virtual label grid in at least one of several directions, including north, south, east and west. In adjusting the coordinates, the user is trying to estimate the adjustment needed so that the printer marks and calibration marks will align upon printing of the next test image. After adjustment of the coordinates of the virtual label grid by the user, a second test image is printed on a second calibration label paper using the printer, wherein the printer again imprints on the paper horizontal and vertical printer marks parallel to their respective calibration marks.

After printing of the second test image, the locations of the printer marks are again compared with the location of their respective calibration marks. If the printer marks exactly align (overlay) their respective calibration marks, then the printer is calibrated for printing labels, and the computing device can be configured to save the current coordinates of the virtual label grid for the printer such that the printer remains calibrated for all subsequent label printing. If, however, the one or both of the printer marks do not overlay their respective calibration marks, then the user must make further adjustments to the coordinates of the virtual label grid on the user interface of the label calibration application, and print another test image to determine whether the printer marks and calibration marks are exactly aligned.

The referenced systems and methods for calibrating a printer for the printing of labels are now described more fully with reference to the accompanying drawings, in which one or more illustrated embodiments and/or arrangements of the systems and methods are shown. The systems and methods are not limited in any way to the illustrated embodiments and/or arrangements as the illustrated embodiments and/or arrangements described below are merely exemplary of the systems and methods, which can be embodied in various forms, as appreciated by one skilled in the art. Therefore, it is to be understood that any structural and functional details disclosed herein are not to be interpreted as limiting the systems and methods, but rather are provided as a representative embodiment and/or arrangement for teaching one skilled in the art one or more ways to implement the systems and methods. Accordingly, aspects of the present systems and methods can take the form of an entirely hardware embodiment, an entirely software embodiment (including firmware, resident software, micro-code, etc.), or an embodiment combining software and hardware. One of skill in the art can appreciate that a software process can be transformed into an equivalent hardware structure, and a hardware structure can itself be transformed into an equivalent software process. Thus, the selection of a hardware implementation versus a software implementation is one of design choice and left to the implementer. Furthermore, the terms and phrases used herein are not intended to be limiting, but rather are to provide an understandable description of the systems and methods.

One salient aspect of the present system is that it requires the use of the calibration label paper of the present application. As mentioned above, the calibration label paper comprises a label area for printing of one or more labels, and a label margin having a horizontal calibration mark and a vertical calibration mark. The calibration label paper is configured to be inserted into a standard computer printer and receive a horizontal printer mark and a vertical printer mark imprinted from the printer upon test printing (printing a "test image"). The calibration marks provide a gauge to the user, which allows the user to determine the amount and direction of adjustment needed to align to printer marks with the calibration marks, and thereby input the adjustment such that a calibration application can calibrate the printer for the printing of labels. A diagram illustrating an exemplary calibrating label paper in accordance with at least one embodiment is shown at FIG. 1.

As shown at FIG. 1, the calibration label paper 100 has a label area 102, a label margin 104, a horizontal calibration mark 106, and a vertical calibration mark 108. As shown in FIG. 1, in one or more embodiments, the horizontal calibration mark 106 and the vertical calibration mark 108 are on opposite sides of the calibration label paper 100. However, in one or more embodiments, the horizontal calibration mark 106 and vertical calibration mark 108 can be on adjacent sides of the calibration label paper 100, or the same side of the paper 100. In an exemplary embodiment, the calibration label paper has dimensions of 8½ inches by 11 inches (i.e., the dimensions of standard letter sized paper); however in one or more embodiments, the calibration label paper can be of any dimension that fits within standard printers, such as the dimensions of legal paper (8½ inches by 14 inches) or A4 paper (210 millimeters by 297 millimeters). Additionally, in one or more embodiments, the calibration label paper 100 can be manufactured using International Organization for Standardization (ISO) 9000 standards.

In FIG. 1, the label area 102 is shown without any grid lines, and as such, in this embodiment the label area 102 can be used to print one large label. However, in one or more embodiments, the label area 102 can comprise a grid of a plurality of labels. In one or more embodiments, the grid of labels comprises labels of equal shape and dimensions. However, in at least one embodiment, the label area 102 can comprise one or more labels of different shapes and dimensions (see FIGS. 7-12). Additionally, while the label margin is shown in FIG. 1 as having a particular width, the width of the margin can vary depending on the number and size of the labels in the label area (see FIGS. 7-12). Further, while the label margin as shown in FIG. 1 has a consistent width for all four sides of the margin, in at least one embodiment, the width of the label margin can vary between the sides. The calibration label paper 100 can come in sets based on the design of the label area 102. In one or more embodiments, for each set of calibration label paper, the calibration marks are located in the same location of the label margin 104 for each paper in the set.

Figure 2:
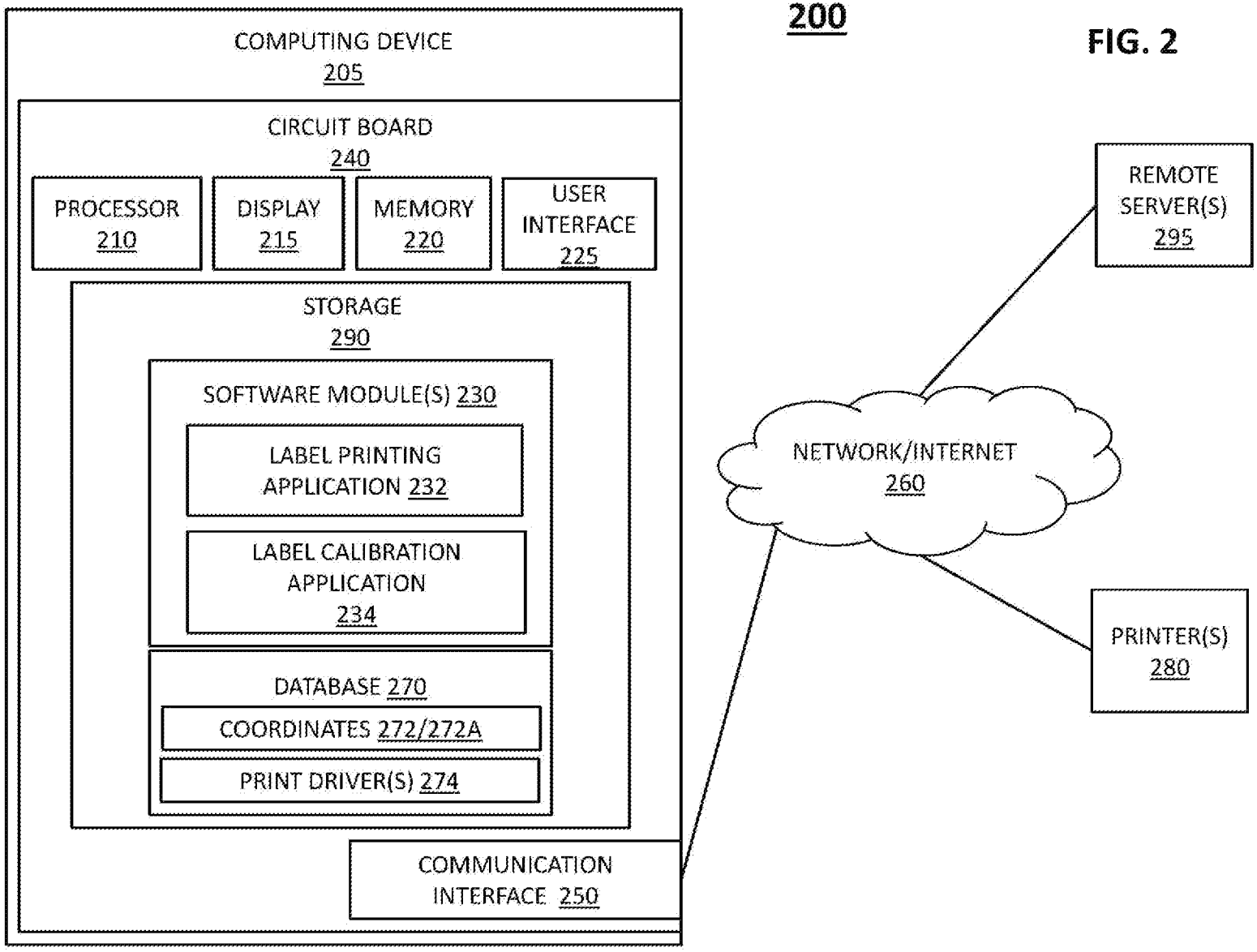
FIG. 2 is a high-level diagram illustrating an exemplary configuration of a system for calibrating a printer for printing labels in accordance with at least one embodiment disclosed herein.

An exemplary system for calibrating a printer for the printing of labels is shown as a block diagram in FIG. 2, which is a high-level diagram illustrating one configuration of the system ("system 200"). In this arrangement, the system 200 includes a computing device 205 of the user ("computing device 205"), which in exemplary implementations can be a personal computer or server. In other implementations, computing device 205 can be a tablet computer, a laptop computer, or a mobile device/smartphone, though it should be understood that computing device 205 of the system 200 can be practically any computing device and/or data processing apparatus capable of embodying the systems and/or methods described herein.

The computing device 205 includes various hardware and software components that serve to enable operation of the system 200, including one or more processors 210, a display 215, a memory 220, a user interface 225, storage 290, and a communication interface 250. Computing device 205 of system 200 also includes a circuit board 240, such as a motherboard, which is operatively connected to various hardware and software components that serve to enable operation of the system 200. The circuit board 240 is operatively connected to the processor 210 and the memory 220. Processor 210 serves to execute instructions for software that can be loaded into memory 220. Processor 210 can be a number of processors, a multi-processor core, or some other type of processor, depending on the particular implementation. Further, processor 210 can be implemented using a number of heterogeneous processor systems in which a main processor is present with secondary processors on a single chip. As another illustrative example, processor 210 can be a symmetric multi-processor system containing multiple processors of the same type.

Preferably, memory 220 and/or storage 290 are accessible by processor 210, thereby enabling processor 210 to receive and execute instructions stored on memory 220 and/or on storage 290. Memory 220 can be, for instance, a random access memory (RAM) or any other suitable volatile or non-volatile computer readable storage medium. In addition, memory 220 can be fixed or removable. Storage 290 can take various forms, depending on the particular implementation. For example, storage 290 can contain one or more components or devices such as a hard drive, a flash memory, a rewritable optical disk, a rewritable magnetic tape, or some combination of the above. Storage 290 can also be fixed or removable.

One or more software modules 230 are encoded in storage 290 and/or in memory 220. The software modules 230 can comprise one or more software programs or applications having computer program code or a set of instructions executed in processor 210. Such computer program code or instructions for carrying out operations for aspects of the systems and methods disclosed herein can be written in any combination of one or more programming languages, including an object oriented programming language, such as Java, Smalltalk, C++, Python, and JavaScript, or the like, and conventional procedural programming languages, such as the "C" programming language or similar programming languages. The program code can execute entirely on computing device 205, partly on computing device 205, as a stand-alone software package, partly on computing device 205 and partly on a remote computer/device, or entirely on the remote computer/device or server. In the latter scenario, the remote computer can be connected to computing device 205 through any type of network, including a local area network (LAN) or a wide area network (WAN), or the connection can be made to an external computer (for example, through the Network/Internet 260 using an Internet Service Provider).

One or more software modules 230, including program code/instructions, are located in a functional form on one or more computer readable storage devices (such as memory 220 and/or storage 290) that can be selectively removable. The software modules 230 can be loaded onto or transferred to computing device 205 for execution by processor 210. It can also be said that the program code of software modules 230 and one or more computer readable storage devices (such as memory 220 and/or storage 290) form a computer program product that can be manufactured and/or distributed in accordance with the present disclosure, as is known to those of ordinary skill in the art.

It should be understood that in some illustrative embodiments, one or more of software modules 230 can be downloaded over a network to storage 290 from another device or system via communication interface 250 for use within system 200. For instance, program code stored in a computer readable storage device in a server can be downloaded over a network from the server to the system 200.

Preferably, included among the software modules 230 is label printing application 232 and label calibration application 234 which are executed by processor 210. During execution of the software modules 230, and specifically the label printing application 232 and label calibration application 234, the processor 210 configures the circuit board 240 to perform various operations relating to calibrating a printer 280, and printing labels with printer 280 and computing device 205, as will be described in greater detail below. It should be understood that while software modules 230 and/or label printing application 232 and/or label calibration application 234 can be embodied in any number of computer executable formats, in certain implementations the software modules comprise one or more applications that are configured to be executed at computing device 205 in conjunction with one or more applications or 'apps' executing at one or more remote devices, such as remote server(s) 295 and/or one or more viewers such as internet browsers and/or proprietary applications.

Label printing application 232 and label calibration application 234 are shown in FIG. 2 as two discrete applications. In such a configuration, label calibration application 234 can be provided separately from the label printing application 232 and is configured to be a stand alone application or plug-in application that is programmed to integrate with the label printing application 232 during operation and/or dynamically modify the operation of the label printing application 232 to provide additional features and functionality relating to calibrating a printer for printing labels and supplementing the operation of the label printing application 232. However, it can be appreciated that various combinations of features and operations of the label calibration application 234 and label printing application 232 described herein can be integrated into one or more software applications. In one or more implementations, label calibration application 234 and/or label printing application 232 can be cloud-based applications. For example, label calibration application can execute on a remote server system and provide calibration instructions to the locally executing printer-driver software component over the network.

Furthermore, in certain implementations, software modules 230 and/or label printing application 232 and/or label calibration application 234 can be configured to execute at the request or selection of a user of one of computing device 205 or remote server(s) 295 (or any other such user having the ability to execute a program in relation to computing device 205, such as a network administrator), while in other implementations computing device 205 can be configured to automatically execute the software modules 230 without requiring an affirmative request to execute. It should also be noted that while FIG. 2 depicts memory 220 oriented on circuit board 240, in an alternate arrangement, memory 220 can be operatively connected to the circuit board 240. In addition, it should be noted that other information and/or data relevant to the operation of the present systems and methods (such as database 270) can also be stored on storage 290, as will be discussed in greater detail below.

Also preferably stored on storage 290 is database 270. As will be described in greater detail below, database 270 contains and/or maintains various data items and elements that are utilized throughout the various operations of system 200, including but not limited to, one or more coordinates of the virtual label grid ("default coordinates 272", "updated coordinates 272A"), and one or more print drivers 274 as will be described in greater detail herein. It should be noted that although database 270 is depicted as being configured locally to computing device 205, in certain implementations database 270 and/or various of the data elements stored therein can be located remotely (such as on remote server(s) 295) and connected to computing device 205 through Network/Internet 260, in a manner known to those of ordinary skill in the art.

A user interface 225 is also operatively connected to the processor. The interface can be one or more input or output device(s) such as switch(es), button(s), key(s), a touch-screen, microphone, etc. as would be understood in the art of electronic computing devices. User Interface serves to facilitate the capture of commands or inputs from the user such as an on-off command, or user information and settings related to operation of the system 200. For example, interface serves to facilitate the capture of certain user inputs for calibrating the printer from the computing device 205 such as adjustments of the virtual label grid.

The computing device 205 can also include a display 215 which is also operatively connected to processor the processor 210. The display 215 includes a screen or any other such presentation device which enables the system to instruct or otherwise provide feedback to the user regarding the operation of the system 200. By way of example, the display can be a digital display such as a dot matrix display or other 2-dimensional display.

By way of further example, the interface 225 and the display 215 can be integrated into a touch screen display. Accordingly, the display is also used to show a graphical user interface, which can display various data and provide "forms" that include fields that allow for the entry of information by the user. Touching the touch screen at locations corresponding to the display of a graphical user interface allows the person to interact with the device to enter data, change settings, control functions, etc. So, when the touch screen is touched, user interface communicates this change to processor, and settings can be changed or user entered information can be captured and stored in the memory.

It should be noted that in certain implementations, such as the one depicted in FIG. 2, one or more printers 280 can be in periodic or ongoing communication with computing device 205. For example, the printer(s) 280 can communicate directly with computing device 205 via a wired or wireless connection, or alternatively can be connected thorough a computer network such as the Internet 260. Though not shown, it should be understood that in certain other implementations, the one or more printers 280 can be in periodic or ongoing direct communication with computing device 205 through communications interface 250. The printer(s) 280 can be any type of printer, including but not limited ink jet printers, laser printers, LED printers, and LCD printers. It should also be noted that, in one or more implementations, the printer 280 itself can comprise one or more of the features of computing device 205, including but not limited to a processor, display, memory, storage, database, a user interface, and/or a communications interface (not shown).

As referenced above, it should also be noted that in certain implementations, such as the one depicted in FIG. 2, one or more remote servers 295 can be in periodic or ongoing communication with computing device 205 through a computer network such as the Internet 260. Though not shown, it should be understood that in certain other implementations, one or more remote servers 295 can be in periodic or ongoing direct communication with computing device 205, such as through communications interface 250.

Communication interface 250 is also operatively connected to circuit board 240. Communication interface 250 can be any interface that enables communication between the computing device 205 and external devices, machines and/or elements. Preferably, communication interface 250 includes, but is not limited to, a modem, a Network Interface Card (NIC), an integrated network interface, a radio frequency transmitter/receiver (e.g., Bluetooth, cellular, NFC), a satellite communication transmitter/receiver, an infrared port, a USB connection, and/or any other such interfaces for connecting computing device 205 to other computing devices and/or communication networks such as private networks and the Internet. Such connections can include a wired connection or a wireless connection (e.g. using the IEEE 802.11 standard) though it should be understood that communication interface 250 can be practically any interface that enables communication to/from the circuit board 240.

It should be noted that while FIG. 2 depicts the system 200 with respect to computing device 205, it should be understood that any number of computing devices can interact with the system 200 in the manner described herein. It should be further understood that a substantial number of the operations described herein are initiated by and/or performed in relation to such computing devices. For example, as referenced above, such computing devices can execute applications and/or viewers that request and/or receive data from computing device 205, substantially in the manner described in detail herein.

In the description that follows, certain embodiments and/or arrangements are described with reference to acts and symbolic representations of operations that are performed by one or more devices, such as those depicted in the system 200 of FIG. 2. As such, it will be understood that such acts and operations, which are at times referred to as being computer-executed or computer-implemented, include the manipulation by processor 210 of electrical signals representing data in a structured form. This manipulation transforms the data and/or maintains them at locations in the memory system of the computer (such as memory 220 and/or storage 290), which reconfigures and/or otherwise alters the operation of the system in a manner understood by those skilled in the art. The data structures in which data are maintained are physical locations of the memory that have particular properties defined by the format of the data. However, while an embodiment is being described in the foregoing context, it is not meant to provide architectural limitations to the manner in which different embodiments can be implemented. The different illustrative embodiments can be implemented in a system including components in addition to or in place of those illustrated for the system 200. Other components shown in FIG. 2 can be varied from the illustrative examples shown. The different embodiments can be implemented using any hardware device or system capable of running program code. In another illustrative example, the system 200 can take the form of a hardware unit that has circuits that are manufactured or configured for a particular use. This type of hardware can perform operations without needing program code to be loaded into a memory from a computer readable storage device to be configured to perform the operations.

For example, computing device 205 can take the form of a circuit system, an application specific integrated circuit (ASIC), a programmable logic device, or some other suitable type of hardware configured to perform a number of operations. With a programmable logic device, the device is configured to perform the number of operations. The device can be reconfigured at a later time or can be permanently configured to perform the number of operations. Examples of programmable logic devices include, for example, a programmable logic array, programmable array logic, a field programmable logic array, a field programmable gate array, and other suitable hardware devices. With this type of implementation, software modules 230 can be omitted because the processes for the different embodiments are implemented in a hardware unit.

In still another illustrative example, computing device 205 can be implemented using a combination of processors found in computers and hardware units. Processor 210 can have a number of hardware units and a number of processors that are configured to execute software modules 230. In this example, some of the processors can be implemented in the number of hardware units, while other processors can be implemented in the number of processors.

In another example, a bus system can be implemented and can be comprised of one or more buses, such as a system bus or an input/output bus. Of course, the bus system can be implemented using any suitable type of architecture that provides for a transfer of data between different components or devices attached to the bus system. Additionally, communications interface 250 can include one or more devices used to transmit and receive data, such as a modem or a network adapter.

Embodiments and/or arrangements can be described in a general context of computer-executable instructions, such as program modules, being executed by a computer. Generally, program modules include routines, programs, objects, components, data structures, etc., that perform particular tasks or implement particular abstract data types.

It should be further understood that while the various computing devices and machines referenced herein, including but not limited to, computing device 205, printer(s) 280, and remote server(s) 295, are referred to herein as individual/single devices and/or machines, in certain implementations the referenced devices and machines, and their associated and/or accompanying operations, features, and/or functionalities can be arranged or otherwise employed across any number of devices and/or machines, such as over a network connection, as is known to those of skill in the art.

The operation of the system 200 and the various elements and components described above will be further appreciated with reference to the method for calibrating a printer for printing labels as described below, in conjunction with FIGS. 3-6.

Figure 3:
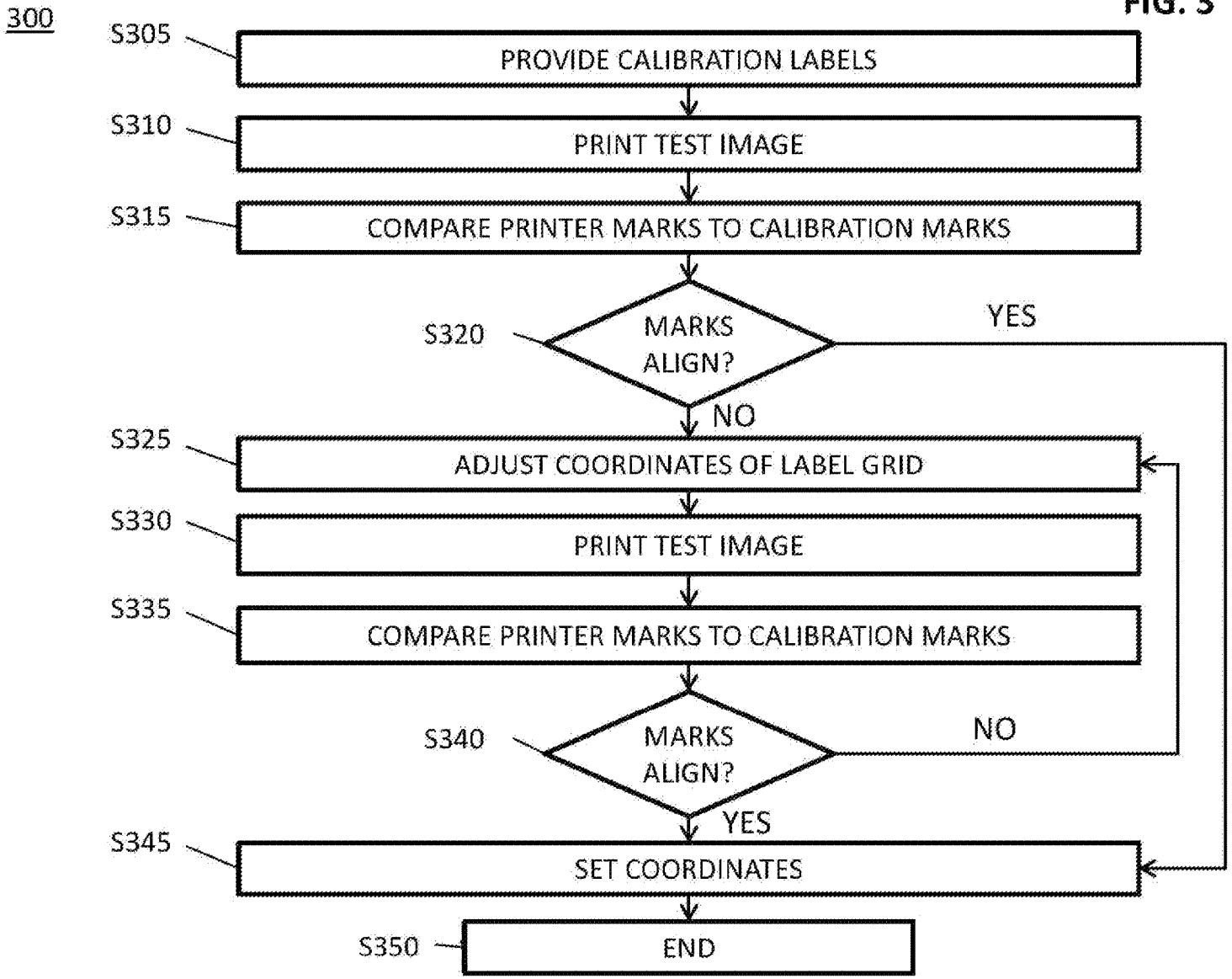
FIG. 3 is a flow diagram showing a routine that illustrates broad aspects of the method for calibrating a printer for printing labels in accordance with at least one embodiment disclosed herein.

FIG. 3 show flow diagram showing routines that illustrates broad aspects of a method for calibrating a printer for printing labels in accordance with one or more embodiments of the present application. It should be appreciated that several of the logical operations described herein are implemented (1) as a sequence of computer implemented acts or program modules running on system 200, and/or (2) as interconnected machine logic circuits or circuit modules within the system 200. The implementation is a matter of choice dependent on the requirements of the device (e.g., size, energy, consumption, performance, etc.). Accordingly, the logical operations described herein are referred to variously as operations, steps, structural devices, acts, or modules. As referenced above, several of these operations, steps, structural devices, acts and modules can be implemented in software, in firmware, in special purpose digital logic, and any combination thereof. It should also be appreciated that more or fewer operations can be performed than shown in the figures and described herein. These operations can also be performed in a different order than those described herein.

FIG. 3 shows a flow diagram showing routine 300 that illustrates a broad aspect of the method of the present application in accordance with at least one embodiment.

The method begins at step S305 where calibration label papers 100 are provided to a printer 280 operatively connected to the computing device 205.

At step S310, the processor 210 executing one or more software modules 230, including preferably label printing application 232 and label calibration application 234 configures the printer 280 to print a test image on a calibration label paper 100. In one or more embodiments, the label calibration application 234 comprises the user interface 225 shown on a display 215 of computing device 205 for viewing by the user. In this embodiment, the user can provide a user input such as clicking on a "test print" button and the user input causes the processor 210 to configure the printer 280 to print a test image. As mentioned above, in printing the test image on a calibration label paper 100, the printer 280 is configured to imprint on the label margin of the calibration label paper 100 a horizontal printer mark parallel to the horizontal calibration mark and a vertical printer mark parallel to the vertical calibration mark (the calibration label paper with the printer marks is referred to as the "test image").

Figure 4:
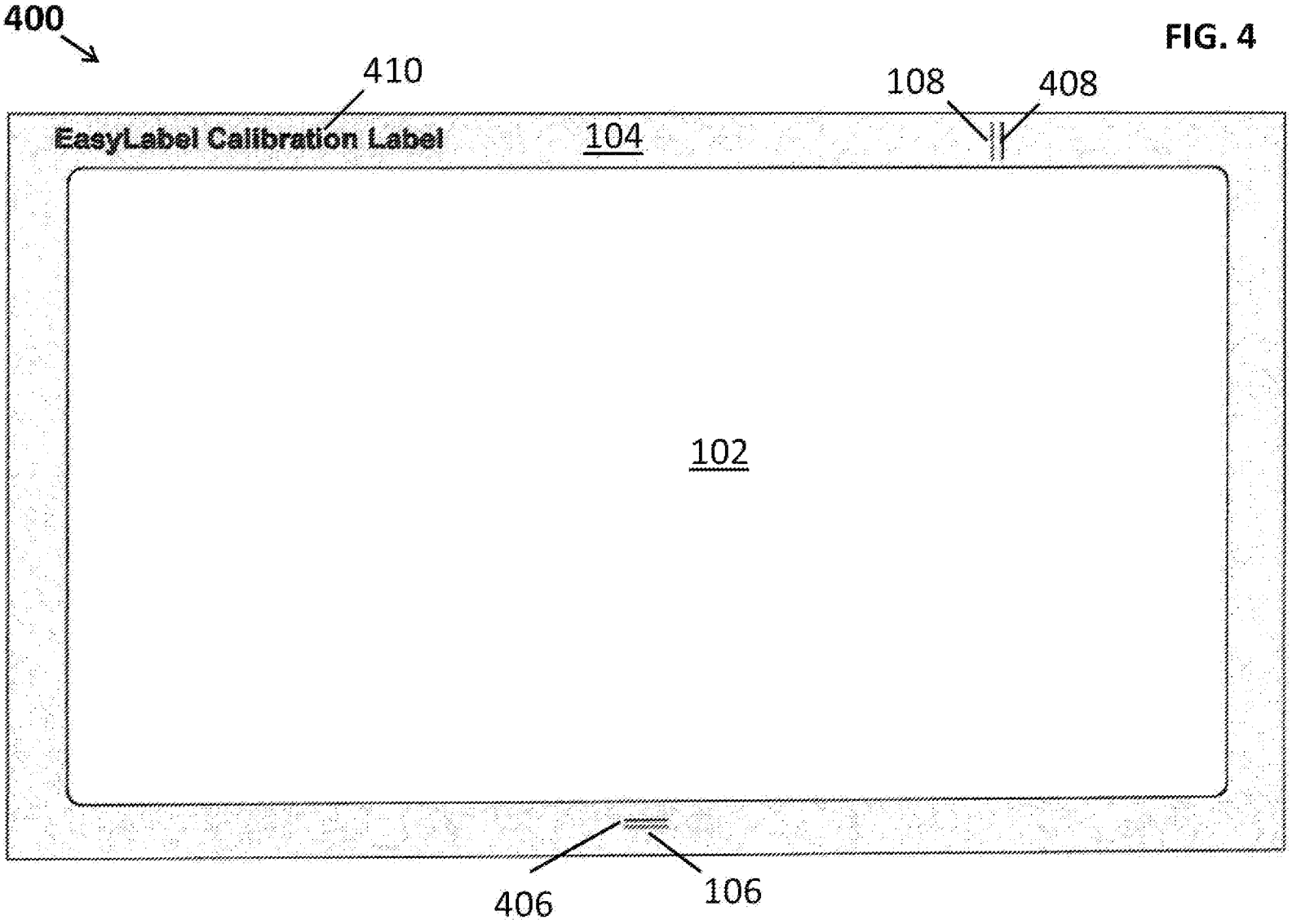
FIG. 4 is a diagram illustrating a test image printed onto the calibrating label paper in accordance with at least one embodiment disclosed herein.

FIG. 4 shows an exemplary test image in accordance with one or more embodiments. As shown at FIG. 4, the test image 400 includes a horizontal printer mark 406 adjacent and parallel to the horizontal calibration mark 106, and a vertical printer mark 408 adjacent and parallel to the vertical calibration mark 108. As seen in FIG. 4, neither the horizontal nor vertical printer marks over lay their respective calibration marks. Thus, because both printer marks need to exactly overlay their respective calibration marks in order for calibration to be complete, the test image 400 of FIG. 4 shows that, in this example, the printer is not yet calibrated for printing labels for the calibration label paper 100. In one or more embodiments the horizontal and vertical printer marks (406 and 408, respectively) can be a different color than the horizontal and vertical calibration marks (106 and 108, respectively) so that the user can distinguish between the printer marks and calibration marks as discussed in greater detail at steps S315 and S335.

It should be noted that in FIG. 4, the calibration marks are located in different locations in the label margin 104 as compared with the calibration marks of FIG. 1. Thus, it should be understood that in various embodiments, the horizontal and vertical calibration marks can be located in various locations within the label margin. It should also be noted that, prior to calibration, each type of printer has its own unique footprint or default print coordinates (default coordinates 272). More specifically, the print driver 274 of the printer converts print coordinates defined by a program (e.g., label printing software) to actual coordinates of the printer head so as to print at the location defined by the program. As such, the present systems and methods help to adjust the conversion process to more accurately print at the location defined by the program and minimize error. Thus, at step S310, the printing of the horizontal and vertical printer marks in the label margin is a manifestation of the printer's unique footprint, where the location for the horizontal and/or vertical printer marks can vary from printer to printer. Said differently, at step S310 the processor 210 configures each printer to print its horizontal and vertical printer marks in its own unique locations in the label margin of calibration label paper.

With continued reference to FIG. 3, at step S315, the location of the horizontal and vertical printer marks in the first test image is compared with the location of their respective calibration marks. In one or more embodiments, such as that of FIG. 4, the printer marks are located adjacent and parallel to their respective calibration marks. As such, the user compares the location to see how much adjustment is needed in order for both printer marks to overlay their respective calibration marks. In one or more embodiments, the printer marks are printed in a color that differs from the color of the calibration marks to enable the user to easily distinguish between them. As stated above, if upon comparison, the printer marks both overlay their respective calibration marks, the printer has been calibrated for that particular type of calibration label paper.

In one or more embodiments, following step S315, at step S320 the processor 210 executing one or more software modules 230, including preferably label printing application 232 and label calibration application 234, configures the computing device 205 to prompt the user. In particular, the computing device 205 is configured to ask the user via a prompt if the printer marks are aligned with their respective calibration marks. The prompt is shown to the user via display 215 via user interface 225. In one or more embodiments, this prompt can be in the form of a "Yes" or "No" question, wherein the prompt also comprises "Yes" and "No" answer buttons configured to receive a user input (e.g., via mouse click). If the user answers affirmatively to the prompt (i.e., that the printer marks do align with their respective calibration marks), then the computing device can be configured to set the coordinates of the label grid as the updated coordinates 272A (step 345), as explained in greater detail below. If, however, the user answers "No" to the prompt (i.e., the printer marks do not both align with their respective calibration marks), then the process proceeds to step S325 where the computing device 205 is configured to adjust the coordinates of the virtual grid (as explained in greater detail below).

In at least one implementation, at step S320, the prompt can ask the user if the vertical or horizontal printer marks, or both align with their respective calibration marks. In this embodiment, the prompt can include answer buttons such as "the vertical marks align", "the horizontal marks align", "both the vertical and horizontal marks align", and "neither the vertical nor horizontal marks align". In this embodiment, if the user answers the question affirmatively (i.e., "the vertical marks align", "the horizontal marks align", or "both the vertical and horizontal marks align"), then the routine proceeds to step S345 where the computing device 205 is configured to set the coordinates of the label grid as the default coordinates 272, as explained in greater detail below. If, however, the user answers "No" to the prompt (i.e., "neither the vertical nor horizontal marks align"), then the process proceeds to step S325 where the computing device 205 is configured to adjust the coordinates of the virtual grid (as explained in greater detail below).

Figure 5:
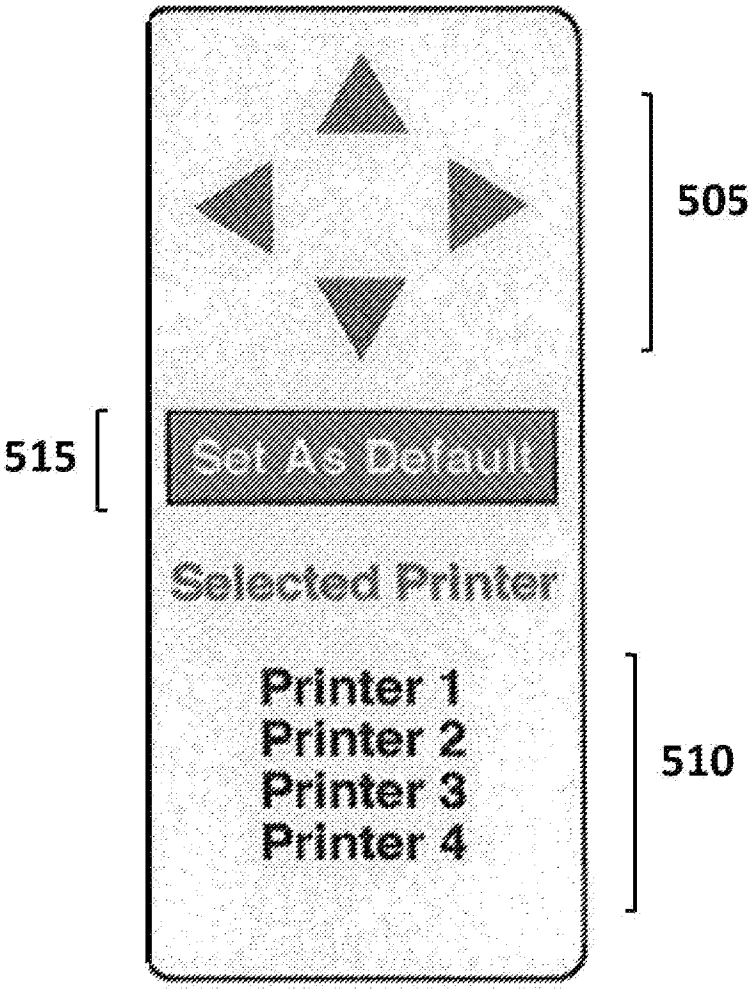
FIG. 5 is a diagram illustrating an adjustment tool of the user interface of the label calibration application in accordance with at least one embodiment disclosed herein.
Figure 6:
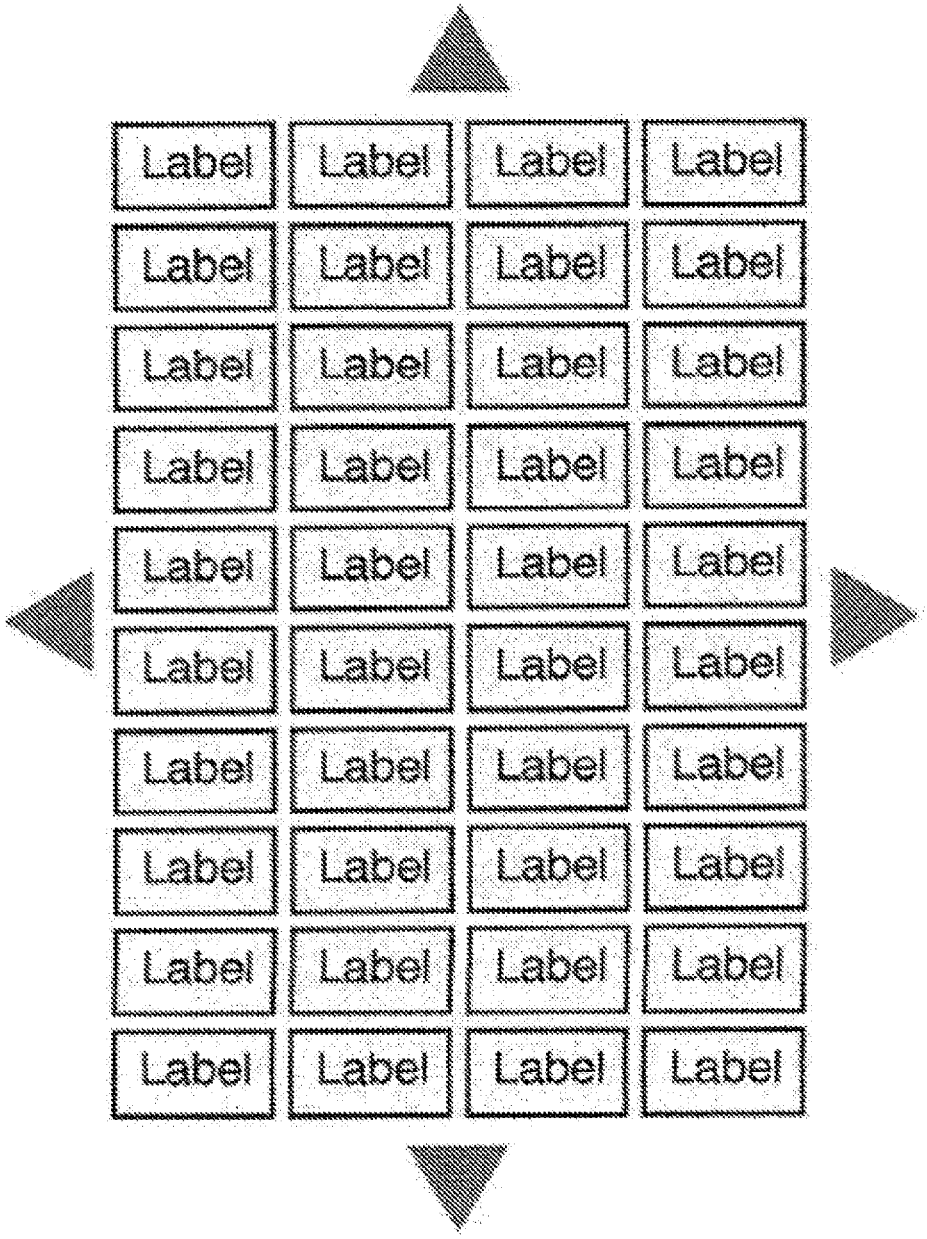
FIG. 6 is a diagram illustrating an exemplary label grid of the label calibration application in accordance with at least one embodiment disclosed herein.

At step S325, the processor 210 executing one or more software modules 230, including preferably label printing application 232 and label calibration application 234, configures the computing device 205 to adjust the coordinates of a virtual label grid corresponding to the calibration label paper. Using the user interface 225 of the label calibration application 234, the user, via user input, can adjust the coordinates of the virtual label grid of the label calibration application 234 (a virtual representation of the calibration label paper) in one or more directions in an attempt to calibrate the printer (i.e., match the printer marks with the calibration marks). For example, in one or more embodiments, the user interface of the label calibration application 234 can include an adjustment tool 500 as shown at FIG. 5. The adjustment tool 500 can comprises directional arrows 505, a printer selection menu 510, and a save button 515 for setting the updated coordinates as the default for a particular printer once calibration is complete. Using the adjustment tool 500, and specifically, the directional arrows 505, the user can adjust the virtual label grid in one or more directions based on the comparison (at step S315) of the location of the printer marks relative to the calibration marks in the first test image.

For example, as shown in FIG. 4, the vertical printer mark 408 is located to the right of the vertical calibration mark 108. As such, following comparison of these marks, the user can click the directional arrows 505 (in this case, the left directional arrow) one or more times to adjust the virtual label grid in an attempt to line up the vertical printer mark 408 and the vertical calibration mark 108. An exemplary virtual label grid 500 is shown at FIG. 5. In one or more embodiments, each click of a directional arrow 505 will adjust (or incrementally move) in the direction of choice by a prescribed number of pixels, for instance, 3 pixels. However, it should be understood that in one or more embodiments, the default number of pixels that the virtual label grid is adjusted per click of the directional arrow 505 can be increased or decreased.

In one or more embodiments, the calibration label paper 100 can comprise an orientation marker as a way of orienting the user as to which direction(s) he or she will need to adjust the virtual label grid in order to calibrate the printer. For example, referring again to FIG. 4, the calibration label paper can have an orientation marker 410 (in this case, the name of the label), which orients the user as to the direction of adjustment. In the example of FIG. 4, the user understands that, when comparing the location of the printer marks to calibration marks, he or she should look at the calibration label paper such that the orientation marker 410 is oriented in the correct direction (i.e., the words of the orientation marker 410 can be read from left to right). In one or more embodiments, the orientation marker 410 can be one or more words, symbols, or images that orient the user as to the directionality that should be used to compare the printer marks with the calibration marks.

Returning to FIG. 3, at step S330, the processor 210 executing one or more software modules 230, including preferably label printing application 232 and label calibration application 234 configures the printer 280 to print another test image on a calibration label paper 100. Once the user has adjusted the virtual label grid to the coordinates that he or she thinks will align one or both of the printer marks with the calibration marks, the printer can be configured to print another test image to verify whether calibration is complete. As discussed above, in one or more embodiments, the label calibration application 234 can comprises a user interface 225 comprising a "test print" button. In this embodiment, the user can provide a user input (e.g., clicking on a "test print" button) and the user input causes the processor 210 to configure the printer 280 to print a test image. As mentioned above, with reference to the printing of a test image at step S310, in printing the second test image on a calibration label paper 100, the printer 280 is configured to imprint on the label margin of the calibration label paper 100 a horizontal printer mark parallel to the horizontal calibration mark and a vertical printer mark parallel to the vertical calibration mark. The location of the vertical printer mark and/or horizontal printer mark in the second test image can be different relative to their locations in the first test image based on the adjustments made by the user to the virtual label grid 500 at step S325.

At step S335, the locations of the horizontal and vertical printer marks in the second test image is compared with the locations of their respective calibration marks. As with step S315, the user compares the locations of the printer marks to the calibration marks to see how much adjustment (if any) is needed in order for one or both printer marks to overlay their respective calibration marks. As stated above, if upon comparison, both printer marks overlay their respective calibration marks, the printer has been calibrated for that particular type of calibration label paper.

In one or more embodiments, following step S335, at step S340 the processor 210 executing one or more software modules 230, including preferably label printing application 232 and label calibration application 234, configures the computing device 205 to prompt the user. In particular, the computing device 205 is configured to ask the user via a prompt if the printer marks are aligned with their respective calibration marks. As with step S320, in one or more embodiments, this prompt can be a "Yes" or "No" question where if the user answers affirmatively to the prompt (i.e., that the printer marks align with their respective calibration marks), then the computing device can be configured to set the coordinates of the label grid as the default coordinates 272/272A (step 345), as explained in greater detail below. If, however, the user answers "No" to the prompt (i.e., both printer marks do not align with their respective calibration marks), then the process proceeds back to step S325 where the computing device 205 is configured to adjust the coordinates of the virtual grid.

Again, like step S320, in at least one embodiment at step S340, the prompt can ask the user if the vertical or horizontal printer marks, or both align with their respective calibration marks. In this embodiment, the prompt can include answer buttons such as "the vertical marks align", "the horizontal marks align", "both the vertical and horizontal marks align", and "neither the vertical nor horizontal marks align". In this embodiment, if the user answers the question affirmatively (i.e., "the vertical marks align", "the horizontal marks align", or "both the vertical and horizontal marks align"), then the routine proceeds to step S345 where the computing device 205 is configured to set the coordinates of the label grid as the updated coordinates 272A, as explained in greater detail below. If, however, the user answers "No" to the prompt (i.e., "neither the vertical nor horizontal marks align"), then the process returns to step S325 where the computing device 205 is configured to adjust the coordinates of the virtual grid.

With continued reference to FIG. 3, at step S345, the processor 210 executing one or more software modules 230, including preferably label printing application 232 and label calibration application 234, configures the computing device 205 to set the coordinates of the virtual label grid as the updates coordinates 272A. In one or more embodiments, the default coordinates 272 for a particular printer are saved in the database 270 of computing device 205 when the printer software (including print driver) is installed on computing device 205 (prior to the calibration process). These default coordinates 272 correspond with the coordinates of the virtual label grid. As such, the adjustment of the coordinates of the virtual label grid (step S325), results in updated coordinates 272A. If the updated coordinates 272A result in the calibration marks aligning with the printer marks, then the updated coordinates are set (e.g., saved) in the database. In one or more embodiments, the updated coordinates 272A can replace the default coordinates 272 for a given printer in the database 270. In at least one embodiment, both the default (272) and update coordinates 272A can remain saved in the database 270.

As mentioned above, although database 270 is depicted as being configured locally to computing device 205, in certain implementations database 270 and/or various of the data elements stored therein can be located remotely (such as on remote server(s) 295) and connected to computing device 205 through Network/Internet 260, in a manner known to those of ordinary skill in the art. Additionally, in at least one embodiment, the default coordinates 272/updated coordinates 272A can be stored in a memory, storage, or database of the printer 280.

As discussed above, if both the vertical and horizontal printer marks overlay their respective calibration marks, then the computing device 205 can be configured to set the coordinates of the virtual label grid as the updated coordinates 272A such that the calibration of the printer is saved for future printing. For example, if at step S340, the user answers "Yes" to the prompt asking if both printer marks overlay their respective calibration, then in one or more embodiments, the coordinates of the virtual label grid can be set as the updated coordinates 272A via user input (e.g., clicking on a button) on the user interface of the label calibration application 234. More particularly, in one implementation (referring again to FIG. 5), a user can click on the "set as default" button 515 located on the adjustment tool 500, thereby causing the computing device 205 to set (save) the coordinates of the virtual label grid as the updated coordinates 272A such that the print driver 274 is configured to default to use the updated coordinates 272A for label printing rather than the original coordinates (default coordinates 272). It should be understood that in one or more embodiments, the "set as default" button can be located in portions of the user interface 225 of label calibration application 234 other than the adjustment tool 500. In at least one implementation, the user's response to the prompt at step S340 can automatically configure the computing device 205 to set the coordinates of the virtual label grid as the updated coordinates 272A without having to click on a "set as default button".

In one or more embodiments, the user can set the coordinates of the horizontal marks and the vertical marks separately. For example, after comparison of the marks at step S335, if the horizontal printer mark matches the horizontal calibration mark, but the vertical printer mark does not match the vertical printer mark, then the user can configure the computing device 205 to set the horizontal mark coordinates as updated coordinates 272A. In one or more implementations, there can be separate buttons for saving (setting) the horizontal mark coordinates and the vertical mark coordinates of the virtual label grid, such that after comparison of the printer and calibration marks, the user can select via user input (clicking on one of the buttons) which coordinates (horizontal, vertical, both, or neither) he or she wants to set (e.g., save).

In at least one implementation in which the prompt at S340 asks the user if the vertical or horizontal printer marks, or both align with their respective calibration marks, the user's response to the prompt can automatically configure the computing device 205 to set the coordinates of the virtual label grid as the updated coordinates 272A without having to click on a "set as default button". For example, if the user clicks the answer button that says "both the vertical and horizontal marks align", the computing device 205 is automatically configured to set both the horizontal and vertical coordinates as the updated coordinates 272A, thereby completing the calibration. Alternatively, if the user clicks the answer button that says "the vertical marks align", the computing device 205 is automatically configured to set the vertical coordinates as updated coordinates 272A, and then the routine would return to step S325 for adjustment of the horizontal coordinates of the virtual label grid (i.e., the coordinates of the horizontal printer mark). Similarly, if the user clicks the answer button that says "the horizontal marks align", the computing device 205 is automatically configured to set the horizontal coordinates as updated coordinates 272A, and then the routine would return to step S325 for adjustment of the vertical coordinates of the virtual label grid (i.e., the coordinates of the vertical printer mark). It should be understood that in at least one implementation in which the user is prompted regarding whether the horizontal and/or vertical marks are aligned, following the user's response to the prompt, the user can still be required to affirmatively set the coordinates as updated coordinates 272A via user input (i.e., clicking on a "set as default" button).

In one or more embodiments, once the updated coordinates 272A corresponding to both the horizontal and vertical printer marks are set (e.g., saved), the printer 280 is calibrated and the updated coordinates 272A are saved for all subsequent label printing with the calibration label paper 100 using the computing device 205 and/or that particular printer. Said differently, the saved updated coordinates 272A will be used automatically for subsequent label printing by the user, and the particular printer will not have to be recalibrated for printing labels using label paper 100 (even printing on a later date) so long as the user is using the same computing device 205 and/or that particular printer. However, in one or more embodiments, if a user using computing device 205 wants to print labels using a different printer, that different printer would need to be calibrated via the methods of the present application. In one or more embodiments, the user also does not need to recalibrate that particular printer for printing labels with calibration label paper 100 regardless of the configuration of the labels in the label area 102.

Once the coordinates are saved and provided as updated coordinates 272A, printer 280 can be configured to print the labels accordingly. In one or more implementations, updated coordinates 272A can be used to modify how the printer operates, such as via print driver 274. The print driver 274 typically interfaces with the printer 280, the computing device 205, or a combination of both. In one or more embodiments, the print driver 274 can be updated, rewritten, or replaced. Text and/or images can be printed onto labels in an orientation and/or location that is defined by the user as a function of updated coordinates 272A. For example, a user can define coordinates that result in the printer 280 printing text and/or images in the center of a label. During execution of the label printing application 232 and label calibration application 234, one or more files can be modified to implement the newly saved coordinates (i.e., updated coordinates 272A) for, for example, all label printing.

In one or more embodiments, the updated coordinates 272A can be used to update the print driver 274, an associated configuration file or both. For example, the print driver 274 can access or interface with an associated configuration file that stores information, such as the updated coordinates 272A. Alternatively, the print driver 274 located on the computing device 205 can be updated or replaced to include the updated coordinates 272A. In yet another alternative embodiment, software provided with the printer 280 (e.g., firmware) can be updated with the newly saved coordinates (i.e., updated coordinates 272A). Thus, the computing device 205 can be configured with an updated or replaced print driver 274 (saved locally), a configuration file associated with a print driver 274 can be updated or replaced, and/or firmware configured with the printer 280 can be updated or replaced. Notwithstanding the respective implementations, the printer 280 can be configured to print labels according to the updated coordinates 272A.

In one or more embodiments, the printer driver 274 is saved in the database 270. As mentioned above, although database 270 is depicted as being configured locally to computing device 205, in certain implementations database 270 and/or various of the data elements stored therein can be located remotely (such as on remote server(s) 295) and connected to computing device 205 and/or printer 280 through Network/Internet 260, in a manner known to those of ordinary skill in the art. Additionally, in at least one embodiment, the print driver 274 can be stored in a memory, storage, or database of the printer 280.

It should be understood that while specific implementations for modifying the print driver 274 are described above, these implementations are merely provided as examples and the application is not limited to such implementations. Rather, various other suitable ways for modifying a print driver are contemplated in the present application.

Once the printer has been calibrated, the process ends at step S350. In one or more embodiments, once the printer is calibrated, the text and/or images are printed on each label in an orientation and/or location that is defined by the user (e.g., centered on each label) with accuracy within at least a 1/64th of an inch.

Figure 7:
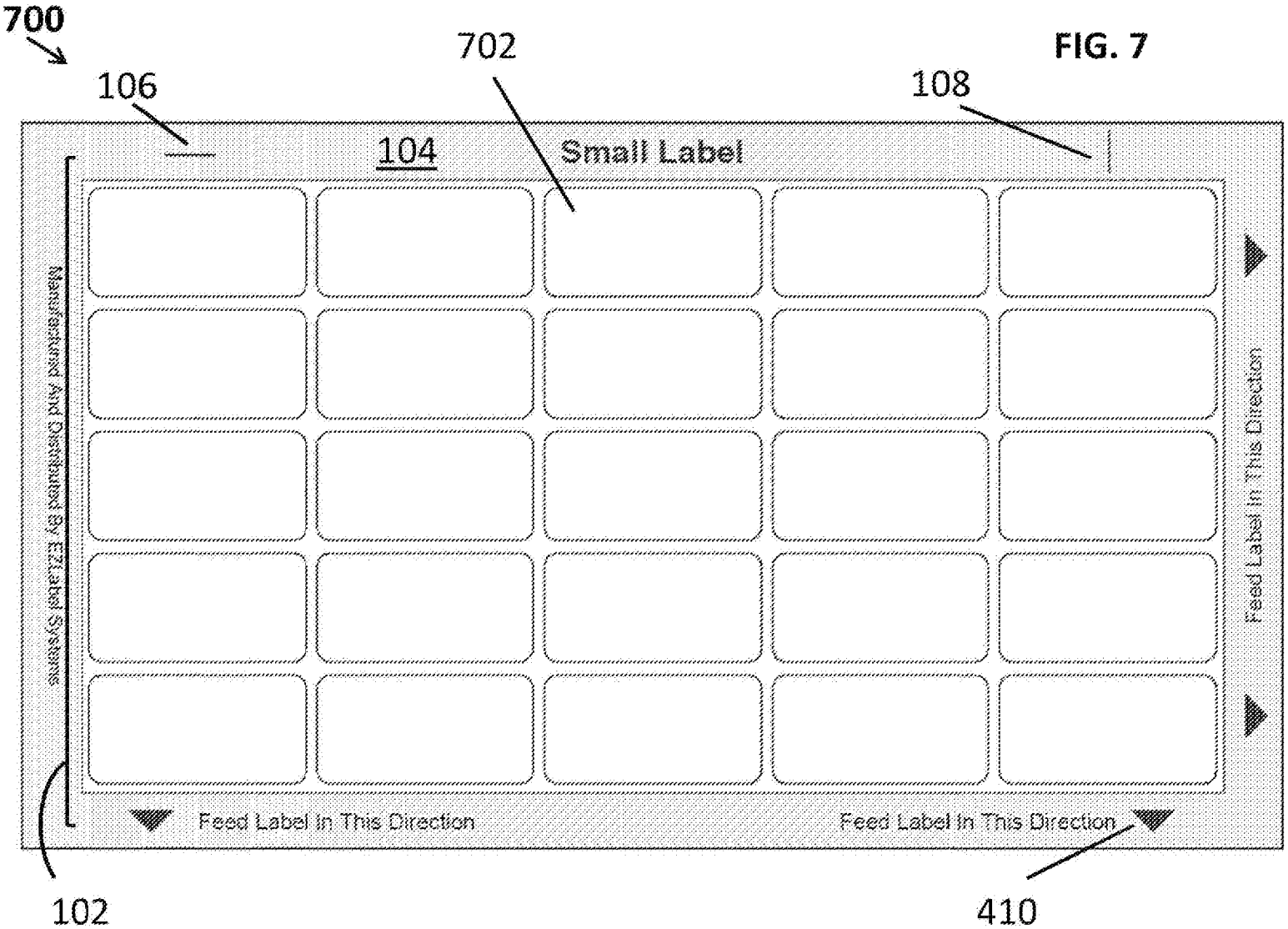
FIG. 7 is a diagram illustrating an embodiment of the calibrating label paper having small labels in accordance with at least one embodiment disclosed herein.
Figure 8:
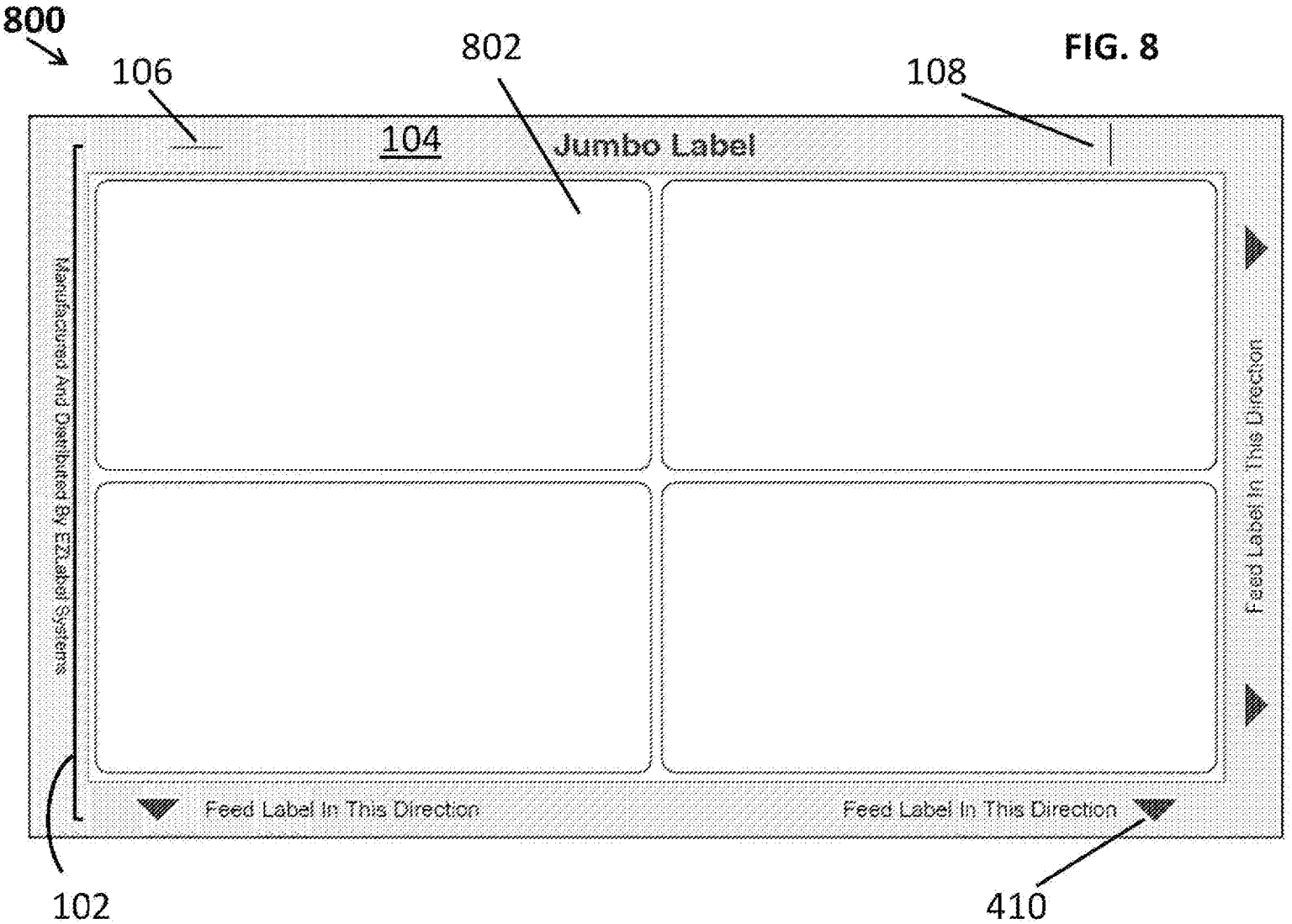
FIG. 8 is a diagram illustrating an embodiment of the calibrating label paper having "jumbo" sized labels in accordance with at least one embodiment disclosed herein.
Figure 9:
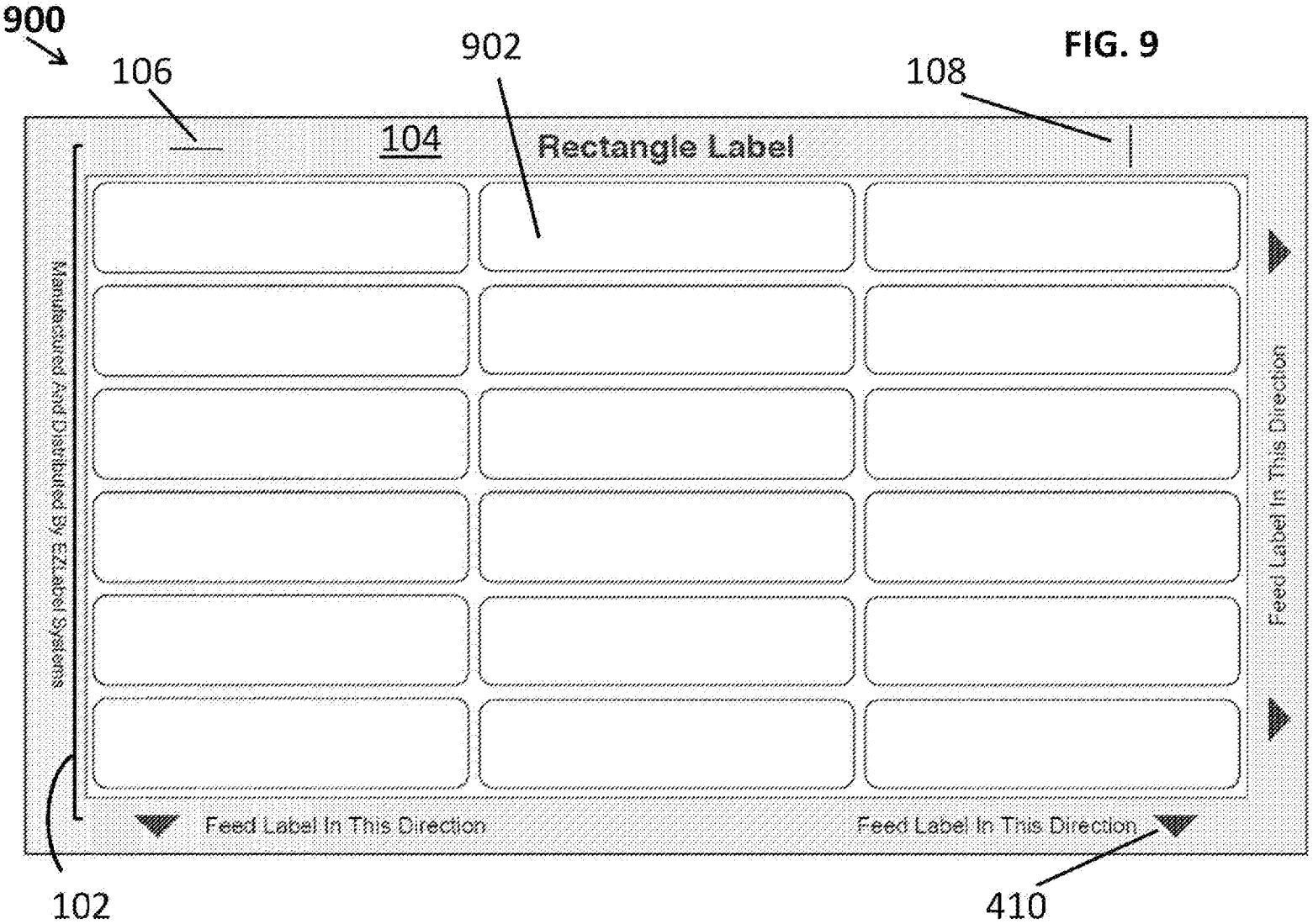
FIG. 9 is a diagram illustrating an embodiment of the calibrating label paper having rectangular labels in accordance with at least one embodiment disclosed herein.
Figure 10:
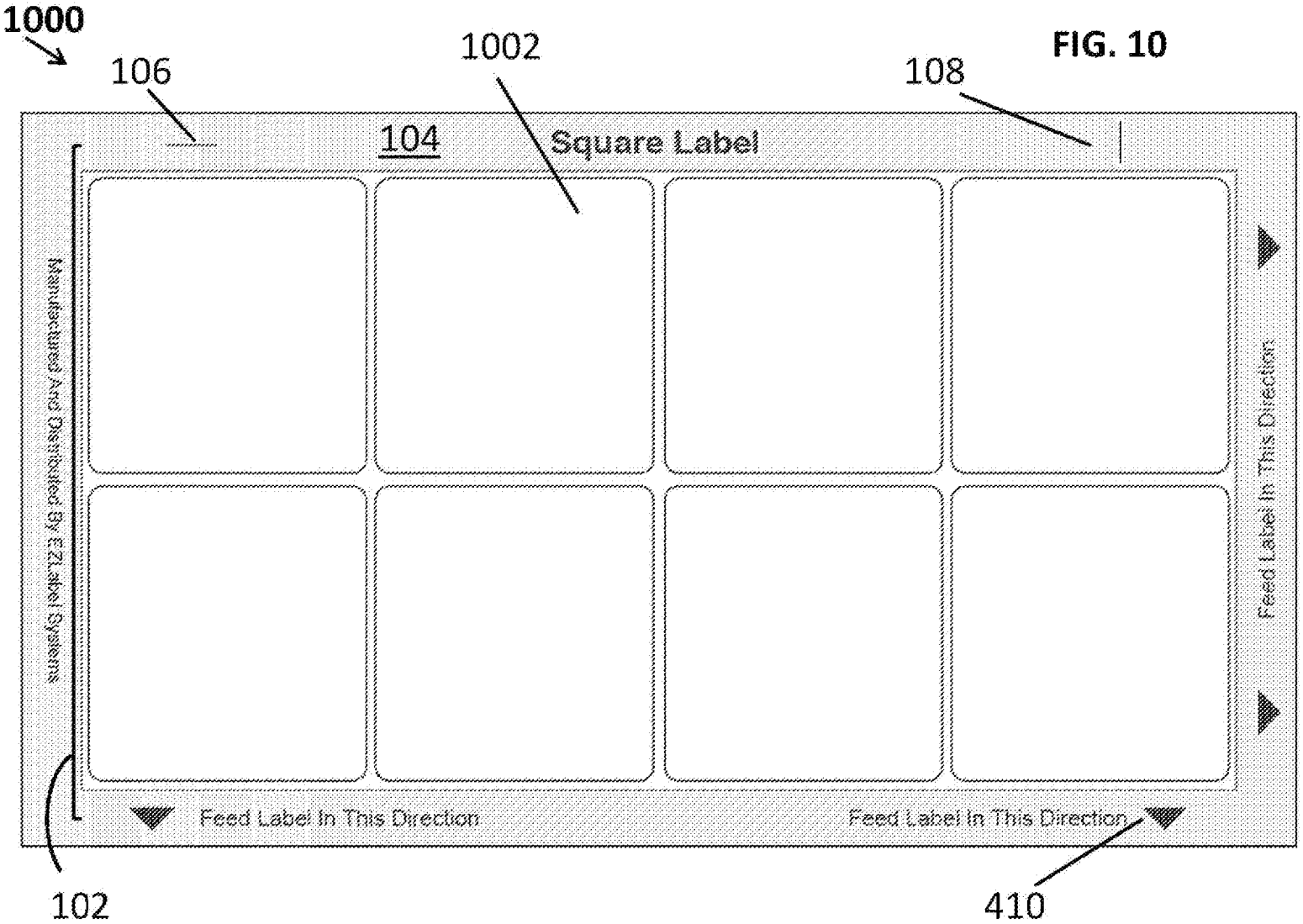
FIG. 10 is a diagram illustrating an embodiment of the calibrating label paper having square labels in accordance with at least one embodiment disclosed herein.
Figure 11:
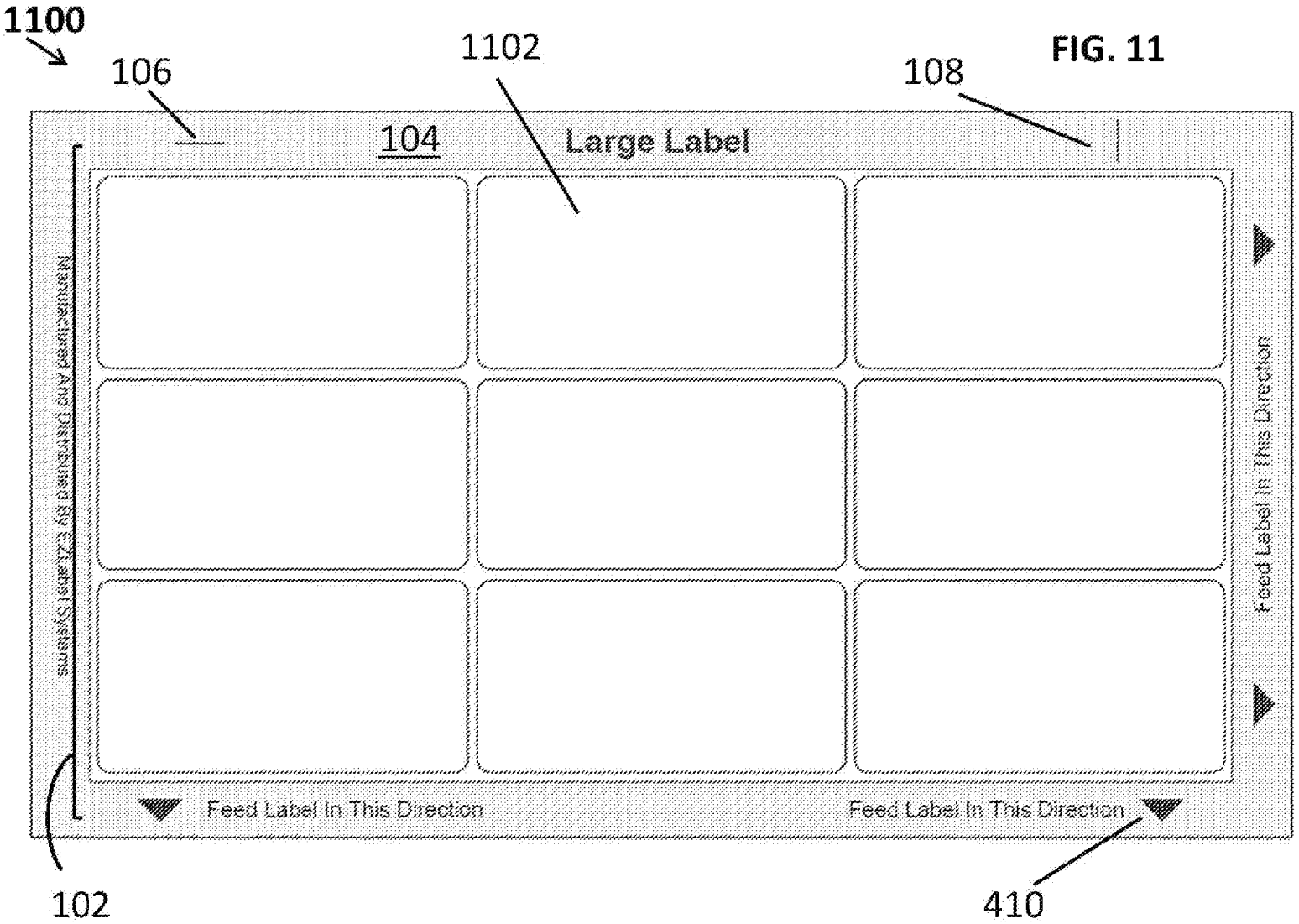
FIG. 11 is a diagram illustrating an embodiment of the calibrating label paper having large labels in accordance with at least one embodiment disclosed herein.
Figure 12:
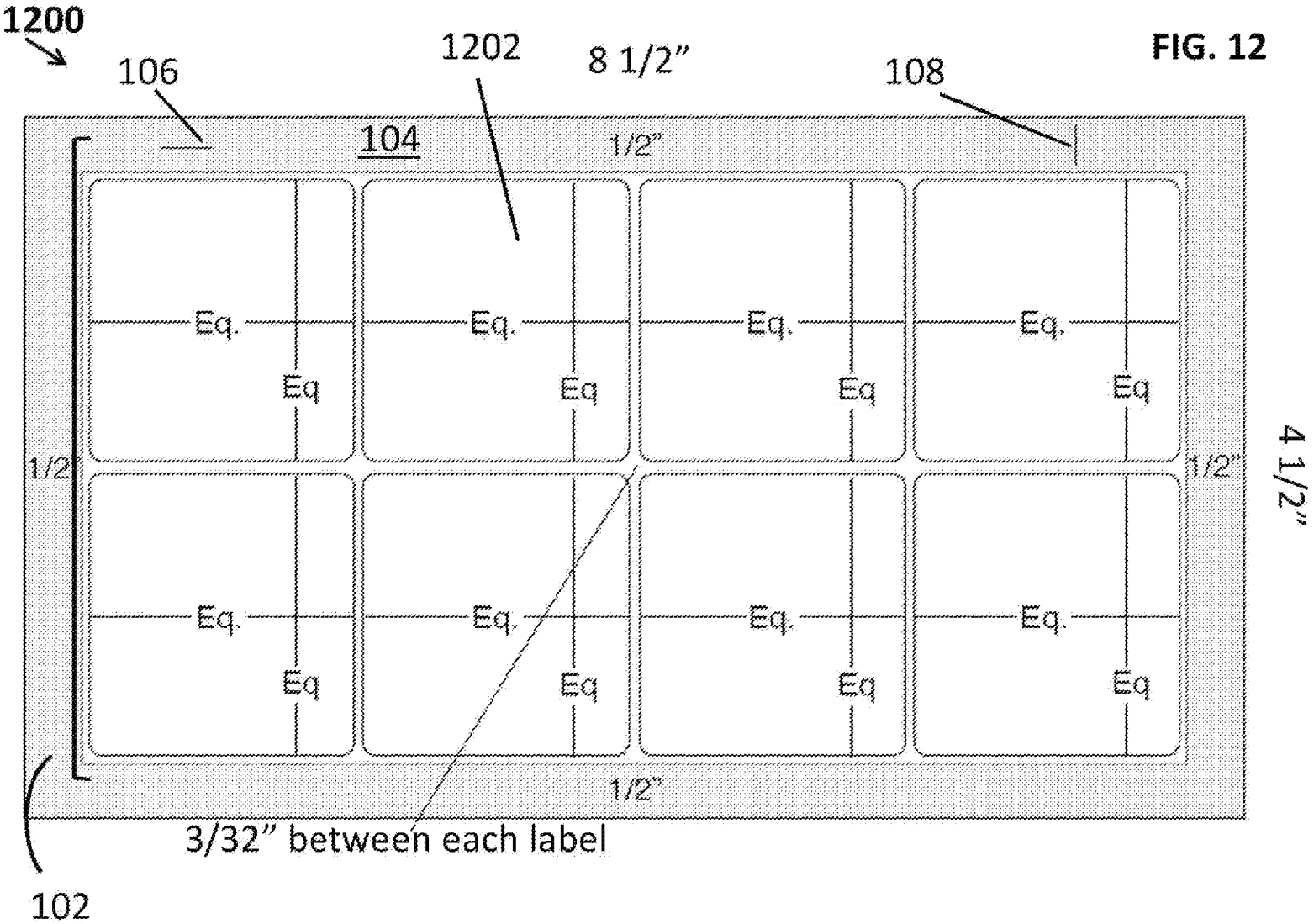
FIG. 12 is a diagram illustrating an embodiment of the calibrating label paper having dimensions of 8½ inches by 4½ inches and having square labels in accordance with at least one embodiment disclosed herein.

As mentioned above, the label area of the calibration label paper can comprise one or more labels of different shapes and dimensions, and the width of the margins of the calibration label paper can vary depending on the number and size of the labels in the label area. FIGS. 7-12 show additional embodiments of the calibrating label paper of the present application having labels of different shapes and dimensions, as well as various paper dimensions in accordance with at least one embodiment disclosed herein. FIG. 7 is a diagram illustrating an alternative calibrating label paper 700 having small labels 702 in accordance with at least one embodiment disclosed herein. FIG. 8 is a diagram illustrating another calibrating label paper 800 having "jumbo" sized labels 802 in accordance with at least one embodiment disclosed herein. FIG. 9 is a diagram illustrating a further embodiment, featuring a calibrating label paper 900 having rectangular labels 902 in accordance with at least one embodiment disclosed herein. FIG. 10 is a diagram illustrating another embodiment, featuring a calibrating label paper 1000 having square labels 1002 in accordance with at least one embodiment disclosed herein. FIG. 11 is a diagram illustrating a further embodiment, featuring a calibrating label paper 1100 having large labels 1102 in accordance with at least one embodiment disclosed herein. As shown in FIGS. 7-11, the orientation marker 410 can be in the form of an arrow. FIG. 12 is a diagram illustrating an alternative embodiment, featuring a calibrating label paper 1200 having dimensions of 8½ inches by 4½ inches. The calibration label paper 1200 also has inch margins and square labels 1202 with 3/32" between each label in accordance with at least one embodiment disclosed herein.

It should be understood that although much of the foregoing description has been directed to systems and methods for calibrating a printer for printing labels, the system and methods disclosed herein can be similarly deployed and/or implemented in scenarios, situations, and settings far beyond the referenced scenarios. It can be readily appreciated that the system 200 can be effectively employed using various label printing interfaces. It should be further understood that any such implementation and/or deployment is within the scope of the system and methods described herein.

It is to be understood that like numerals in the drawings represent like elements through the several figures, and that not all components and/or steps described and illustrated with reference to the figures are required for all embodiments or arrangements. It should also be understood that the embodiments, implementations, and/or arrangements of the systems and methods disclosed herein can be incorporated as a software algorithm, application, program, module, or code residing in hardware, firmware and/or on a computer useable medium (including software modules and browser plug-ins) that can be executed in a processor of a computer system or a computing device to configure the processor and/or other elements to perform the functions and/or operations described herein. It should be appreciated that according to at least one embodiment, one or more computer programs, modules, and/or applications that when executed perform methods of the present disclosure need not reside on a single computer or processor, but can be distributed in a modular fashion amongst a number of different computers or processors to implement various aspects of the systems and methods disclosed herein.

Thus, illustrative embodiments and arrangements of the present systems and methods provide a computer implemented method, computer system, and computer program product for calibrating a printer for the printing of labels. The flowcharts and block diagrams in the figures illustrate the architecture, functionality, and operation of possible implementations of systems, methods and computer program products according to various embodiments and arrangements. In this regard, each block in the flowchart or block diagrams can represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present disclosure, which is set forth in the following claims.

The invention claimed is:

1. A method for calibrating a printer for printing labels, the method comprising:

providing a set of calibration label papers to a printer operatively connected to computing device, wherein each calibration label paper comprises a horizontal calibration mark and a vertical calibration mark located in a margin of the calibration label paper;

printing a first test image on a first calibration label paper using the printer, wherein the test image comprises a first horizontal printer mark parallel to the horizontal calibration mark and a first vertical printer mark parallel to the vertical calibration mark;

comparing, using the first test image, the horizontal calibration mark to the first horizontal printer mark and the vertical calibration mark to the first vertical printer mark;

adjusting, using the computing device, coordinates of a virtual label grid representing the calibration label paper based on the comparison of the horizontal calibration mark to the first horizontal printer mark and the vertical calibration mark to the first vertical printer mark, wherein the computing device includes a hardware processor configured to execute code in the form of one or more modules stored in non-transitory storage medium;

printing a second test image on a second calibration label paper using the printer, wherein the printer imprints on the second calibration label paper a second horizontal printer mark parallel to the horizontal calibration mark and a second vertical printer mark parallel to the vertical calibration mark;

comparing, using the second test image, the horizontal calibration mark to the second horizontal printer mark and the vertical calibration mark to the second vertical printer mark; and saving the adjusted coordinates of the virtual label grid as default coordinates for the printer.

* * * * *